US008430118B2

(12) United States Patent
Xiong

(10) Patent No.: US 8,430,118 B2
(45) Date of Patent: Apr. 30, 2013

(54) AUTOMATIC FLUSH DEVICE

(75) Inventor: Def Xiong, Shanghai (CN)

(73) Assignee: Shanghai Kohler Electronics, Ltd., Shanghai (CN)

( * ) Notice: Subject to any disclaimer, the term of this patent is extended or adjusted under 35 U.S.C. 154(b) by 391 days.

(21) Appl. No.: 12/823,522

(22) Filed: Jun. 25, 2010

(65) Prior Publication Data

US 2010/0327201 A1 Dec. 30, 2010

Related U.S. Application Data

(63) Continuation-in-part of application No. PCT/CN2008/002090, filed on Dec. 26, 2008.

(30) Foreign Application Priority Data

Dec. 27, 2007 (CN) ..... 2007 1 0173418

(51) Int. Cl.
*F16K 31/18* (2006.01)

(52) U.S. Cl.
USPC ..... 137/419; 137/418; 137/448; 4/406; 4/414

(58) Field of Classification Search ..... 137/129, 137/409, 418, 419, 448, 389, 390, 392; 4/302–305, 4/368, 375, 376, 313, 406, 407, 414
See application file for complete search history.

(56) References Cited

U.S. PATENT DOCUMENTS

| | | | | |
|---|---|---|---|---|
| 1,436,350 | A * | 11/1922 | Lundberg | 4/363 |
| 1,461,673 | A * | 7/1923 | Papin | 4/375 |
| 5,187,818 | A * | 2/1993 | Barrett et al. | 4/313 |
| 6,250,601 | B1 * | 6/2001 | Kolar et al. | 4/623 |
| 6,877,170 | B1 * | 4/2005 | Quintana et al. | 137/392 |
| 7,921,480 | B2 * | 4/2011 | Parsons et al. | 4/313 |
| 2006/0010591 | A1 | 1/2006 | Bush | |

FOREIGN PATENT DOCUMENTS

| | | | |
|---|---|---|---|
| CN | 2758342 | Y | 2/2006 |
| CN | 2787744 | Y | 6/2006 |
| CN | 101058995 | A | 10/2007 |
| CN | 101196013 | A | 6/2008 |
| DE | 102006020611 | A1 | 11/2007 |
| KR | 1020050083447 | A | 8/2005 |

OTHER PUBLICATIONS

International Search Report: PCT/CN2008/002090, Apr. 2, 2009.

* cited by examiner

*Primary Examiner* — Craig Schneider
*Assistant Examiner* — Craig J Price
(74) *Attorney, Agent, or Firm* — Foley & Lardner LLP

(57) ABSTRACT

An automatic flush device is provided that is mounted in a water tank. The automatic flush device includes an inlet control module, a lever module for discharging water and a tank module. The inlet control module includes an inlet element linked to the inlet tube and a solenoid valve set at the inlet element. The lever module for discharging water has a cup connected with the solenoid valve by a filling tube. An electronic sensing controller controls the opening and closing of the solenoid valve to fill water into the cup. When the cup is full of water, the lever unbalances and slants to control the flushing of the water tank. Therefore, it is easy to control water current while requiring minimal power, thereby saving electric energy.

12 Claims, 3 Drawing Sheets

AUTOMATIC FLUSH DEVICE

FIELD OF THE INVENTION

The present invention relates to an automatic flush device and in particular an automatic flush device applied in a tank toilet.

BACKGROUND OF THE INVENTION

In the prior art, a tank toilet is usually manual, such as a knob-lifting type tank toilet and a button-piston type tank toilet, for example. A knob-lifting type tank toilet generally includes a rod, a lifting member and a knob. As it is needed to flush, the water in the tank can be released by rotating a knob, thereby moving a rod and lifting a lifting member to pull an outlet plug out so that a flush is completed. A piston-button type tank toilet generally includes a moveable outlet plug and a button structure. As it is needed to flush, a moveable outlet plug is lifted by pressing a button structure to flush.

With the development of technology, the old manual tank toilet can not satisfy people's needs. So, the automatic flush toilet appeared in the prior art. It senses the user by a sensor to control the flush and the automatic flush device controls the water flush by an electric motor to lift the outlet plug instead of handling by hands. This automatic flush toilet is more convenient and sanitary. Its operation principle is as follows. The sensor detects the user entering into a sensing area, and then it detects the user leaving the sensing area after a while. At this time, the sensor sends signals to an electronic sensor controller and then the controller judges that it is required to flush at this time according to a preset program. Thus, the controller drives the electric motor to pull the outlet plug out to release the water in the tank and flush the toilet.

In the prior art, a sensor not only detects the users, but also other things, such as the toilet lid. Generally speaking, when the toilet is used, the toilet lid is opened. Therefore the detection of the toilet lid position is also one of the preferred sensing methods. The sensing methods can be infrared sensing or electromagnet sensing, for example. In the prior art, there also exists microwave sensing and pressure sensing, for example.

However, the automatic flush toilet in the prior art needs extra power to drive the electric motor to rotate and bring out the outlet plug, requiring large power consumption. It is difficult to improve the old manual tank toilet to achieve the object of automatic flush.

Therefore, it is desirable to invent a reliable and energy-saving automatic flush device to be applied to a tank toilet. At the same time, it is desirable that this automatic flush device be easily usable with existing tank toilets, thereby upgrading existing manual tank toilets to achieve an automatic flush.

SUMMARY OF THE INVENTION

An aspect or embodiment of this invention is to provide an automatic flush device mounted in the tank toilet, the automatic flush device being energy-saving and reliable. The automatic flush device is mountable in a tank and adapted for receiving outside signals to control the flush. The automatic flush device includes a water filling control module, a lever module and a tank module. The water filling control module includes a water filling part linked to a water inlet tube, a solenoid valve for controlling water current, a water filling tube connected with the solenoid valve, and an electronic sensing controller receiving outside signals, for example. The lever module includes a supporting member, a lever mounted at the supporting member, a cup mounted at one end of the lever and connected to the water filling tube, and a lifting member mounted at the other end of the lever, for example. The tank module includes a water supply component for the tank and an outlet plug connected to the lifting member, wherein the water supply component for the tank has a floater for controlling the water level in the tank, for example.

Another aspect or embodiment of this invention is that the water filling control module further includes a pipe line linked to the water inlet tube and a solenoid valve is set at the pipe line. The lever module for discharging the water includes a cup connected to the solenoid valve by a water filling tube.

Another aspect or embodiments of this invention includes an electronic sensing controller for controlling the opening and closing of the solenoid valve to fill the water into the cup. When the cup is full of water, the lever will slant to control the flush of the water tank.

Compared with the prior art, a useful effect of this invention is that this invention does not need an extra power source, but only needs to fill water to the cup. It has no requirement for hydraulic pressure and it is easy to control water current. Therefore, it needs lower power and saves electric energy.

In addition, the automatic flush device in this invention may also be used to improve an existing manual tank toilet by adding an automatic sensing flush function while retaining the original tank components, which is desirable for upgrading the toilet by saving cost and being practical.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific details disclosed herein are not to be interpreted as limiting, but merely as a basis for the claims and as a representative basis for teaching one skilled in the art to variously employ the present invention in virtually any appropriate manner. Further, in reference to the drawings, the same structure parts or functions are marked with the same numbers on the drawings.

Figure 1:
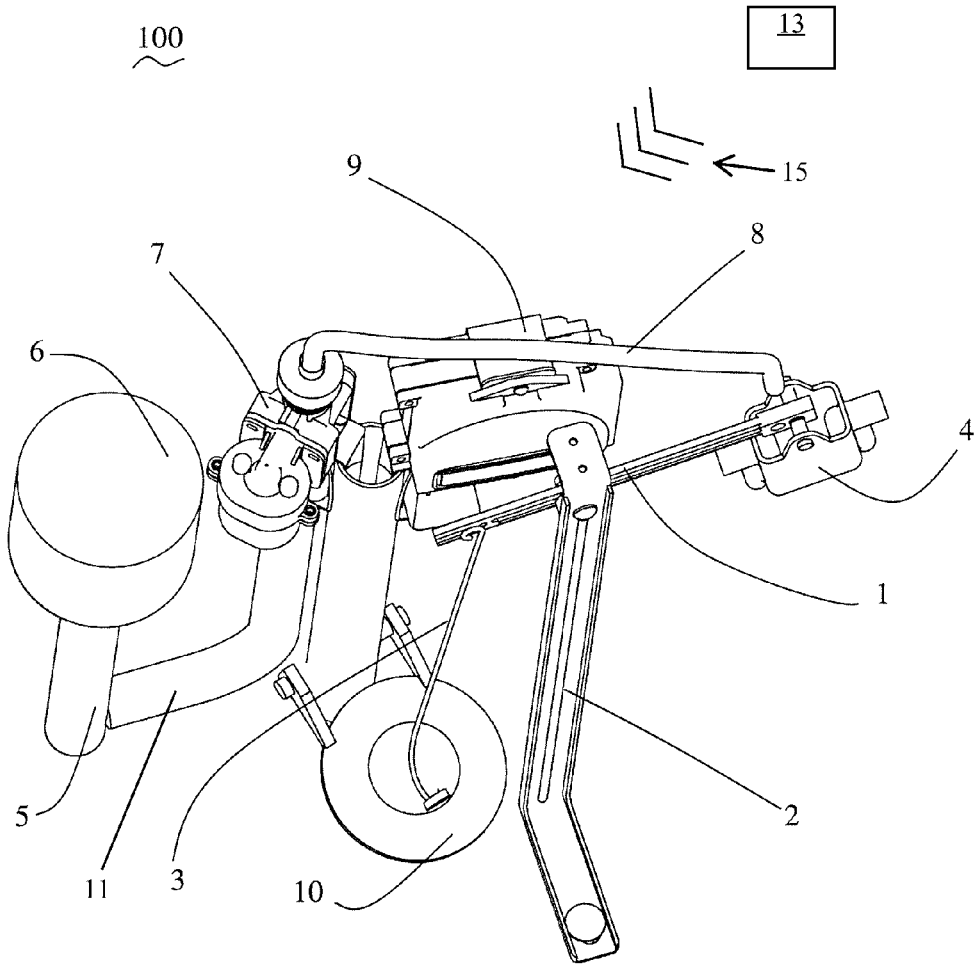
FIG. 1 is a perspective view of an embodiment of an automatic flush device.

As shown in FIG. 1, an embodiment of an automatic flush device 100 includes a lever module, a water filling control module and a tank module. The lever module comprises a lever 1, a support member 2, a lifting member 3, and a cup 4. The water filling control module includes a water filling part 5, a solenoid valve 7 for controlling the water current, a water filling tube 8 and an electronic sensing controller 9. The water filling control module may include a pipe line 11 where the solenoid valve 7 is set (e.g., provided) at the pipe line 11. The tank module includes a water supply component for the tank and an outlet plug 10. The water supply component for the tank has a floater 6 for controlling the water level in the water tank.

Figure 2:
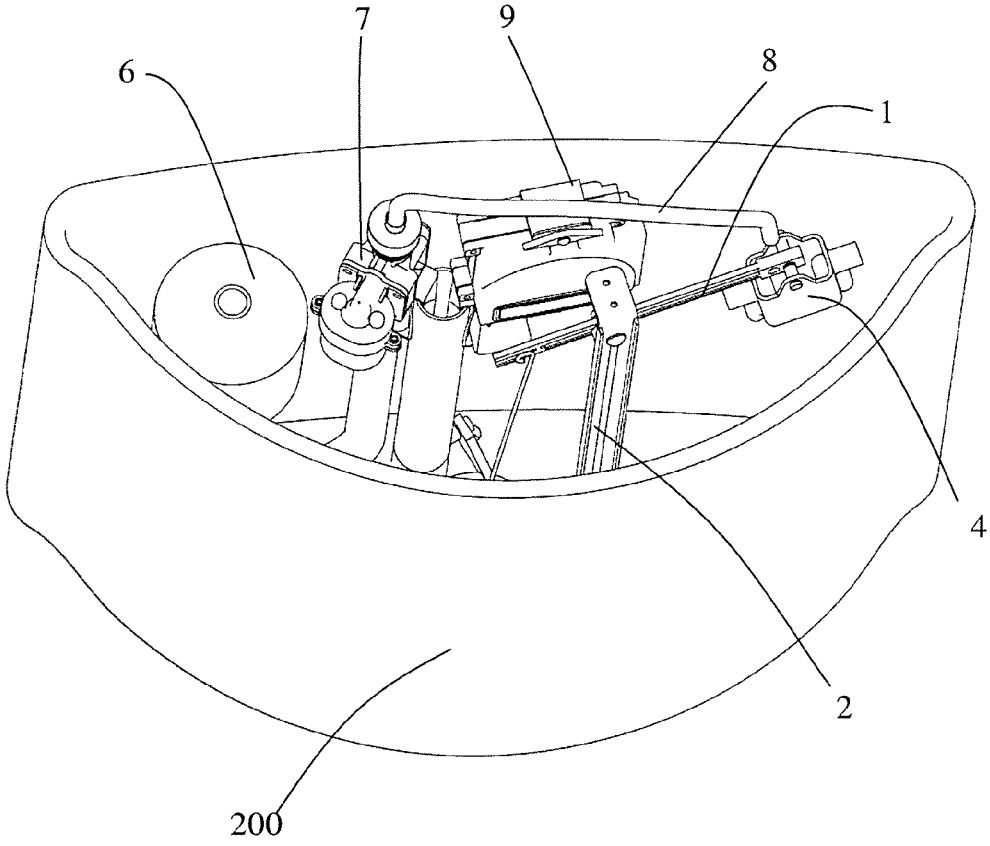
FIG. 2 is a perspective view of the automatic flush device of FIG. 1 mounted in a water tank.

As shown in FIG. 2, the automatic flush device 100 is mounted in a tank 200. The tank 200 receives added water by the water filling part 5 (generally a tee joint module) from a water source. The floater 6 is used to stop the water from entering the tank 200 when the water level in the tank 200 reaches a determined level. Meanwhile, the water filling part 5 is also used to add water into the water filling tube 8 controlled by the solenoid valve 7. In the illustrated embodiment shown in FIG. 1 and FIG. 2, the structure of the floater 6 is a simple schematic structure. Therefore it can adopt the general floater structure known in this field.

The electronic sensing controller 9 receives outside signals 15, such as signals from an infrared sensing device mounted outside the tank 200 and electronic control signals sent by pressing the keys in the remote control unit 13, for example. For instance, the infrared sensing device may send control signals for flushing water to the electronic sensing controller 9 after the user leaves the toilet. The controller 9 controls the opening and closing to the solenoid valve 7 when receiving the corresponding control signals.

The water filling tube 8 is connected between the solenoid valve 7 and the cup 4. When the solenoid valve 7 opens, the water will flow into the cup 4 through the water filling tube 8.

The cup 4 is mounted rotationally at one end of the lever 1. The lifting member 3 is mounted at the other end of the lever 1, and the bottom of the lifting member 3 is connected to the outlet plug 10. The lever 1 is fixed at the supporting member 2 rotatably. The arm of lever 1 with the cup 4 is longer than the arm of lever 1 with the lifting member 3, which enables the lever 1 to tilt with less water so that the outlet plug 10 is raised more easily.

During operation, the electronic sensing controller 9 receives an outside signal to drive the solenoid valve 7, and then the water goes through the tee joint water filling part 5 and the water filling tube 8 into the cup 4 set at one end of the lever 1. When the cup 4 contains enough water, the lever 1 loses its balance and the lifting member 3 raises the outlet plug 10 of the tank 200, which enables the tank 200 to flush water. When the water in the tank 200 is discharged out, the water supply component for the tank 200 is controlled by the floater 6 to add water to the tank 200 for the next use.

Figure 4:
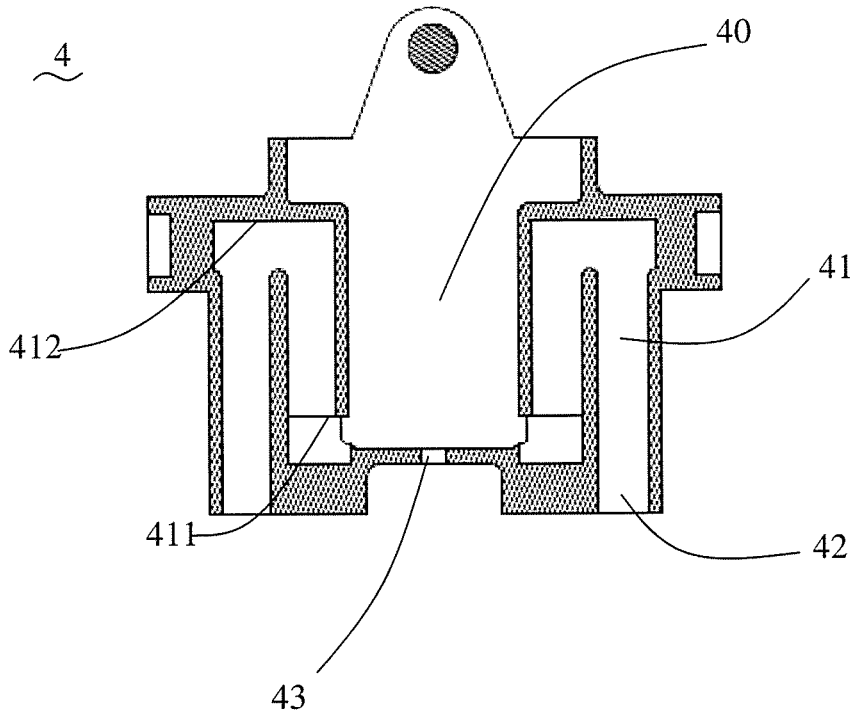
FIG. 4 is a cross-sectional view of another embodiment of a siphon cup.

The cup 4 can be a simple cup-shaped structure. A discharge hole 43 (as shown in FIG. 4) may be set close to the bottom of the cup-shaped structure. The capacity of the water from the filling tube 8 is larger than that of the water discharged through the discharge hole 43, so that the water in the cup 4 is increased continuously when the water filling tube 8 is filling water into the cup 4. The lever 1 tilts to flush water when the water in the cup 4 reaches a certain level.

After the tank 200 flushes water, the water filling tube 8 stops to fill water to the cup 4. The water in the cup 4 flows out through the discharge hole 43, which enables the lever 1 back to its original position, and the outlet plug 10 closes the outlet. Then water is added to the tank 200.

Figure 3:
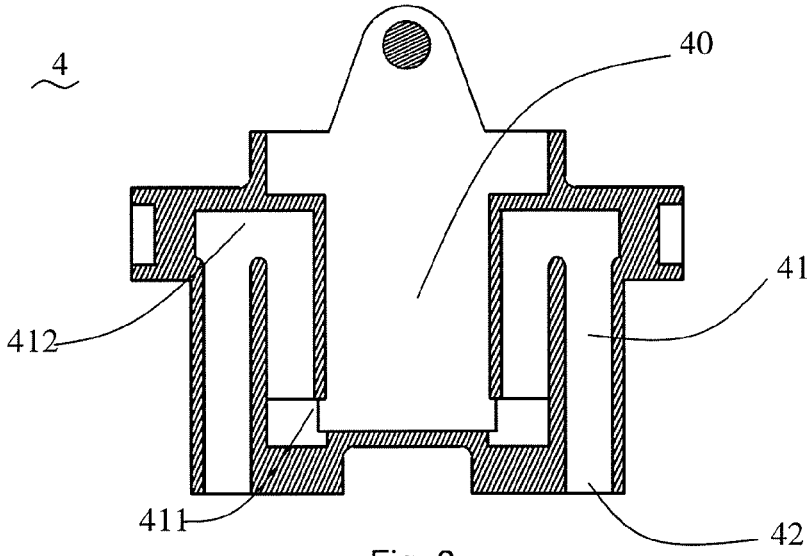
FIG. 3 is a cross-sectional view of a siphon cup.

In the illustrated embodiment of an automatic flush device as shown in FIG. 3, the cup 4 may adopt a preferred design of a siphon cup. The siphon cup 4 includes a water containing cavity 40, a siphon bent pipe 41 connected to the bottom of the water containing cavity 40, and an outlet 42. To keep the cup 4 working well in the process of filling and discharging the water, two sets of a siphon bent pipe 41 and an outlet 42 are mounted symmetrically at the two sides of the siphon cup 4, for example. Alternatively, a siphon bent pipe 41 and an outlet 42 can be set as only one group in another embodiment of this invention. The siphon bent pipe 41 includes a first opening 411 at the joint place between the siphon bent pipe 41 and the water containing cavity 40, and a second opening 412 at the top of the siphon bent pipe 41. To get a more ideal siphon effect, the size of the second opening 412 is adapted to be as same as the size of the first opening 411, for example.

During the process of filling water to the siphon cup 4, the siphon cup 4 begins to discharge water on only when the siphon cup 4 is full of a certain amount of water. The water discharging will not be stopped until the water in the siphon cup 4 is discharged out due to a siphon effect. This structure enables the lever 1 to tilt strongly and quickly. The structure of this siphon cup 4 ensures that the water will not be discharged as soon as it is begins to be filled with water. Therefore, it will not extend the discharged time or negatively influence usage of the toilet.

In another embodiment of this invention illustrated in FIG. 4, referring to special cases (such as the power is suddenly off), the water in the siphon cup 4 can not be fully discharged so that the lever 1 can not go back to its initial state. A discharge hole 43 is set at the bottom of the water containing cavity 40 of the siphon cup 4 to discharge the remained water in the siphon cup 4. However, in the process of practical use, the capacity of filling water in the water filling tube 8 is very large. Therefore, the siphon cup 4 would not be unable to work.

In another preferred embodiment of the automatic flush device 100 of this invention, the time that the solenoid valve 7 fills the water into the siphon cup 4 can be controlled to enable the tank 200 to flush water in a small or large capacity corresponding to liquid or solid waste in order to save water. When a small capacity of flushing water is needed, the time that the solenoid valve 7 fills the water into the siphon cup 4 can be shorter, as only the filled water amount can make the lever 1 lose balance. At this time, the lever 1 quickly resets because of the quick water discharging. The lifting member 3 only keeps the plug 10 of the tank 200 raised for a short of time period, so the small capacity of water in the tank 200 is discharged out to flush. When a large capacity of water is needed, the time that the solenoid valve 7 fills the water into the siphon cup 4 can be longer, which enables the lever 1 to lose balance for a longer time. The lifting member 3 will keep pulling the plug 10 of the tank 200 out for longer time, so the water in the tank 200 can be discharged out entirely to effect flushing with a large capacity of water.

The illustrated embodiments of the automatic flush device 100 do not influence the manual lift structure of a manual tank, and therefore the original manual structure can still be used. However, the automatic flush device 100 of this invention can certainly upgrade an existing manual tank. In addition, the automatic flush device 100 of this invention also can be used in a new automatic flush tank.

It is understood that the preceding description is given merely by way of illustration and not in limitation of the invention and that various modifications may be made thereto without departing from the scope of the invention as claimed.

The invention claimed is:

1. An automatic flush device mounted in a water tank and adapted to receive an outside signal and to control flushing, comprising:

a water filling control module comprising:

a water filling part configured to receive water;

a solenoid valve for controlling a flow of water;

a water filling tube connected with the solenoid valve; and an electric sensing controller for receiving an outside signal;

a lever module comprising:

a supporting member;

a lever mounted on the supporting member;

a cup mounted at a first end of the lever, the cup being fluidly connected with the water filling tube; and a lifting member set at a second end of the lever;

an outlet plug connected to the lifting member, and a floater for controlling a water level in the water tank.

2. The automatic flush device according of claim 1, wherein the lever includes a first arm to which the cup is coupled and a second arm to which the lifting member is coupled, and the first arm is longer than the second arm.

3. The automatic flush device according of claim 1, wherein the cup is a siphon cup.

4. The automatic flush device according of claim 3, wherein the cup comprises a water containing cavity and a first siphon bent pipe provided at a first side of the water containing cavity and a second siphon bent pipe provided at a second side of the water containing cavity.

5. The automatic flush device according of claim 4, wherein each of the first and second siphon bent pipes comprises a first opening at a joint place between the respective siphon bent pipe and the water containing cavity, and a second opening at the top of the respective siphon bent pipe, wherein a size of the second opening is the same as a size of the first opening.

6. The automatic flush device according of claim 1, wherein an outlet is set near the bottom of the cup.

7. The automatic flush device according of claim 1, wherein the outside signal is one of an infrared sensing signal or an electronic control signal of a remote control unit.

8. An automatic flush device mounted in a water tank, comprising:

a water filling control module comprising:

a pipe line linked to a water filling tube;

a solenoid valve set at the pipe line to control a flow of water from the pipe line to the water filling tube;

a cup rotationally coupled to a lever module for discharging water, wherein the cup is fluidly connected to the water filling tube;

a tank module; and an electronic sensing controller for controlling an opening and a closing of the solenoid valve to selectively fill water into the cup, wherein when the cup is full of water, the lever slants to control the flushing of the water tank.

9. The automatic flush device according of claim 8, wherein the cup is a siphon cup.

10. The automatic flush device according of claim 9, wherein the cup comprises a water containing cavity and a first siphon bent pipe provided at a first side of the water containing cavity and a second siphon bent pipe provided at a second side of the water containing cavity.

11. The automatic flush device according of claim 10, wherein each of the first and second siphon bent pipes comprises a first opening at a joint place between the respective siphon bent pipe and the water containing cavity, and a second opening at a top of the respective siphon bent pipe, wherein a size of the second opening is the same as a size of the first opening.

12. The automatic flush device according of claim 8, wherein a discharge hole is set near the bottom of the cup.

* * * * *